United States Patent [19]

Tomita et al.

[11] 4,220,126

[45] Sep. 2, 1980

[54] IGNITION TIMING CONTROL DEVICE FOR AN INTERNAL COMBUSTION ENGINE

[75] Inventors: Kazuo Tomita, Gotenba; Nobuo Habu, Susono, both of Japan

[73] Assignee: Toyota Jidosha Kogyo Kabushiki Kaisha, Toyota, Japan

[21] Appl. No.: 39,641

[22] Filed: May 16, 1979

[30] Foreign Application Priority Data

Jul. 24, 1978 [JP] Japan ..... 53/90199
Feb. 2, 1979 [JP] Japan ..... 54/13209

[51] Int. Cl.[3] ..... F02P 5/04; F02M 25/06

[52] U.S. Cl. ..... 123/411; 123/568

[58] Field of Search ..... 123/117 A, 117 R, 119 A

[56] References Cited

U.S. PATENT DOCUMENTS

| | | | |
|---|---|---|---|
| 3,915,132 | 10/1975 | Thornburgh | 123/117 A |
| 4,031,869 | 6/1977 | Onishi et al. | 123/117 A |
| 4,083,335 | 4/1978 | Ohata | 123/117 A |
| 4,098,245 | 7/1978 | Ohata | 123/117 A |
| 4,124,006 | 11/1978 | Rodenkirch | 123/117 A |
| 4,147,143 | 4/1979 | Harada | 123/117 A |
| 4,151,818 | 5/1979 | Tateno | 123/117 A |

*Primary Examiner*—P. S. Lall
*Attorney, Agent, or Firm*—Finnegan, Henderson, Farabow, Garrett & Dunner

[57] ABSTRACT

An ignition timing control device for an internal combustion engine incorporating exhaust gas recirculation and vacuum advancing of ignition timing, the device including a check valve which holds the largest vacuum which appears in the vacuum port during opening process of the intake throttle valve for the vacuum advancer and a delay means which delays transmission of the largest vacuum to the vacuum advancer.

8 Claims, 6 Drawing Figures

IGNITION TIMING CONTROL DEVICE FOR AN INTERNAL COMBUSTION ENGINE

BACKGROUND OF THE INVENTION

The present invention relates to an ignition timing control device for an internal combustion engine incorporating an exhaust gas recirculation (EGR) system, and, more particularly, to an ignition timing control device which provides the most desirable amount of advance of ignition timing when the engine is operated with exhaust gas recirculation.

When exhaust gas recirculation is performed in an internal combustion engine, the combustion speed of fuel-air mixture in the combustion chamber of the engine lowers. Therefore it is generally desirable that the advance angle of ignition timing should be increased when exhaust gas recirculation is performed, so that deterioration or drivability and/or fuel consumption should be avoided.

Further, in view of the fact that, when intake manifold vacuum increases, the combustion speed of fuel-air mixture in the combustion chamber of an internal combustion engine lowers, it is known to incorporate a vacuum advancer in an internal combustion engine, which advances ignition timing for fuel-air mixture in accordance with the magnitude of intake manifold vacuum. Such a vacuum advancer generally comprises a diaphragm means and is adapted to advance ignition timing in accordance with vacuum supplied to the diaphragm chamber of the diaphragm means. In this case, the diaphragm chamber is generally supplied with vacuum taken from a vacuum port at a position upstream of a throttle valve in the intake passage of the engine when the throttle valve is fully closed and which is downstream of the throttle valve when the throttle valve is opened beyond a predetermined relatively small angle. The vacuum taken from the above-mentioned vacuum port is zero when the throttle valve is in full closed position, i.e. when the engine is in idling condition, and rapidly increases as the throttle valve is gradually opened so as to traverse the vacuum port, and then gradually decreases as the throttle valve is further opened. Therefore, when ignition timing is advanced by the diaphragm type vacuum advancer operated by the vacuum taken from the above-mentioned vacuum port, advance angle becomes the maximum when the throttle valve has just traversed the front of the vacuum port, and then, as the throttle valve is further opened, advance angle decreases. This ignition timing advance characteristic available from a vacuum advancer is certainly satisfactory when exhaust gas recirculation is not performed. However, exhaust gas recirculation is generally performed so that it is initiated when the throttle valve is opened beyond a predetermined opening and that the ratio of exhaust gas recirculation is increased as the throttle valve is further opened. Therefore, the advance angle of ignition timing available from the above-mentioned vacuum advancer does not conform to the requirement for advancing of ignition timing from the point of view of exhaust gas recirculation. This disagreement will cause poor power output of the engine and/or deterioration of fuel consumption.

In order to solve this problem, it has been proposed in U.S. Letters Pat. Nos. 4,191,143 and 4,191,147 to incorporate a parallel combination of a vacuum-operated control valve and a check valve in a passage which connects the diaphragm means of the vacuum advancer and the vacuum port, said vacuum-operated control valve being adapted to operate in relation to operation of the exhaust gas recirculation system so as to hold the maximum vacuum generated in the passage for the diaphragm means when the exhaust gas recirculation is performed, so that vacuum advance of ignition timing is effected by the maximum vacuum as long as exhaust gas recirculation is performed. However, although these systems provide a desirable advance angle of ignition timing which conforms to the requirement imposed by exhaust gas recirculation, when the engine is accelerated there occurs the problem that the NOx content of the exhaust gases of the engine substantially increases due to holding of the largest advance angle obtained at a particular opening of the throttle valve during its opening process.

SUMMARY OF THE INVENTION

It is therefore the object of the present invention to deal with this problem and to provide a further improved ignition timing control device which particularly provides a more desirable ignition timing control performance during acceleration of the engine.

In accordance with the present invention, the above-mentioned object is accomplished by an ignition timing control device for an internal combustion engine having intake and exhaust passages and an exhaust gas recirculation system which includes an exhaust gas recirculation control valve and selectively recirculates exhaust gases from said exhaust passage to said intake passage, comprising a vacuum advancer which has a diaphragm means and advances ignition timing of the engine in accordance with vacuum supplied to said diaphragm means, first and second passage means which alternatively connect said intake passage and said diaphragm means so as to conduct fluid pressure therebetween, a delay and hold means related with said second passage means which includes a check valve, a surge space and a delay means and delays transmission of vacuum from said intake passage to said diaphragm means effected through said second passage means, while it holds the largest vacuum generated in said second passage means for said diaphragm means, and a changeover means which changes over connection of said intake passage and said diaphragm means between a route through said first passage means and a route through said second passage means in accordance with operation of said exhaust gas recirculation system so that, when exhaust gas recirculation is not performed, said intake passage and said diaphragm means are connected through said first passage means, and, when exhaust gas recirculation is performed, said intake passage and said diaphragm means are connected through said second passage means.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

Figure 1:
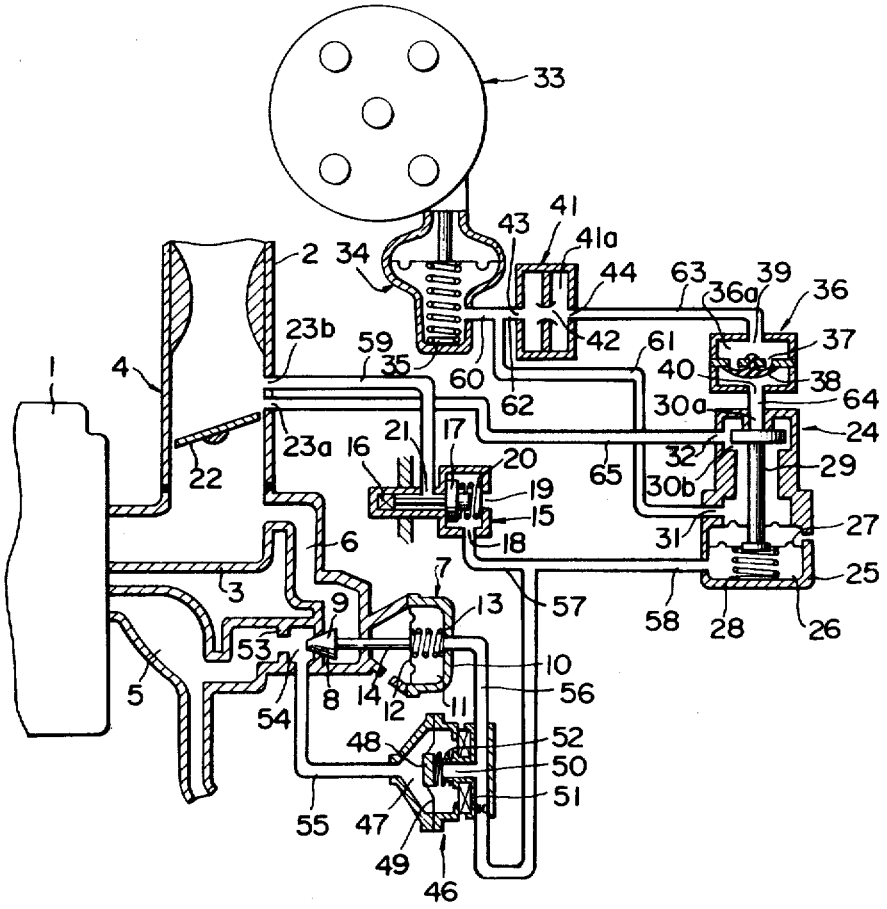
FIG. 1 is a diagrammatical view showing a first embodiment of the ignition timing control device of the present invention.

Referring now to FIG. 1, an engine partly shown and designated by reference numeral 1 has an intake system 4 having a carburetor 2 and an intake manifold 3, an exhaust manifold 5, and an EGR system which comprises a passage means 6 through which a part of the exhaust gases flowing through the exhaust manifold is recirculated towards the intake manifold 3 and an EGR valve 7 which controls opening of the passage means 6. The EGR valve 7 has a valve element 9 which opens or closes a valve port 8 formed at a middle portion of the passage means 6, and a diaphragm means 10 which operates the valve element 9 in such a manner that when vacuum higher than a predetermined level is not supplied to its diaphragm chamber 11, its diaphragm 12 is shifted leftwards in the figure by the action of a compression coil spring 13 so as to urge the valve element 9 against the valve port 8 by way of a valve rod 14, thereby intercepting the passage means 6, and in such a manner that, when vacuum above a predetermined level is supplied to the diaphragm chamber 11, the diaphragm 12 is shifted rightward in the figure against the action of the compression coil spring 13, so as to remove the valve element 9 from the valve port 8, thereby opening the passage means 6.

A thermostat valve 15 is adapted to respond to temperature of the engine and which has a thermosensitive portion 16, which, for example, responds to the temperature of engine cooling water which represents temperature of the engine, and a valve element 17 which is driven by said thermosensitive portion so as to be positioned in the shown position where it connects a port 18 to a release port 19 when engine temperature is below a predetermined value, and so as to be shifted rightward in the figure against the action of a compression coil spring 20 so as to isolate the port 18 from the release port 19 and to connect the port 18 to a port 21 when engine temperature is above a predetermined value. By incorporating this thermostat valve in the shown system for the control of exhaust gas recirculation and ignition timing, the device of the present invention is operated only when engine temperature is above a predetermined value.

The carburetor 2 incorporates a throttle valve 22 and two vacuum ports 23*a* and 23*b* which are located upstream of the throttle valve when it is fully closed and which are located downstream of the throttle valve when it is opened beyond a predetermined opening. Although the vacuum ports 23*a* and 23*b* are shown in the figure as being arranged as axially spaced along the inlet bore, this diagrammatical arrangement is only for the purpose of illustration, and in fact these two vacuum ports are arranged side by side close to each other circumferentially spaced around the periphery of the intake bore of the carburetor.

A vacuum operated valve 24 has diaphragm means 25, which has a diaphragm 27, which is shifted upwards in the figure by the action of a compression coil spring 28 when its diaphragm chamber 26 is not supplied with vacuum above a predetermined value, so that its valve element 29 closes a valve port 30*a* while it opens a valve port 30*b* so as to connect ports 31 and 32. by contrast, when the diaphragm chamber 26 is supplied with vacuum above a predetermined value, the diaphragm 27 is shifted downwards in the figure against the action of the compression coil spring 28, so that the valve element 29 closes the valve port 30*b* while it opens the valve port 30*a* so as to isolate the ports 31 and 32 from each other and to connect the ports 32 and the valve port 30*a*.

33 designates a distributor, the ignition timing of which is advanced by a diaphragm operated vacuum advancer 34, as vacuum is supplied to its diaphragm chamber 35.

A one-way check valve 36 has ports 37, a flexible valve element 38 which covers the ports 37, and inlet and outlet ports 39 and 40, and which is adapted to allow fluid to flow only from the port 39 towards the port 40.

A delay means 41 has a throttling orifice 42 and ports 43 and 44, and which is adapted to delay transmission of vacuum therethrough. The throttling performance of this delay means may be determined, for example, so as to provide air flow of 100–800 cc/min. under pressure difference of 500 mmHg.

46 designates a back pressure control valve for exhaust gas recirculation, which is so constructed that, when exhaust gas pressure supplied to its diaphragm chamber 47 is below a predetermined value, a valve element 48 supported by a diaphragm 49 opens a port 50 towards the atmosphere through an air filter 51, and when exhaust gas pressure supplied to the diaphragm chamber 47 is above a predetermined value, the valve element 48 is shifted rightwards in the figure against the action of a compression coil spring 52 so as to close the port 50. The diaphragm chamber 47 is supplied with exhaust gas pressure existing in a chamber 54 provided at a middle portion of the passage means 6 as located downstream of an orifice 53 which is also provided at a middle portion of the passage means 6, by way of a passage means 55. The device composed of the back pressure control valve 46 and the orifice 53 operates to maintain exhaust gas pressure in the chamber 54 always at a constant level by controlling vacuum supplied to the diaphragm chamber 11 of the EGR valve 7, and thus operates to maintain a constant ratio of exhaust gas recirculation.

The diaphragm chamber 11 of the EGR valve 7 is connected with the port 18 of the thermostat valve 15 by way of passage means 56 and 57. The diaphragm chamber 26 of the vacuum operated valve 24 is connected with the port 18 of the thermostat valve 15 by way of passage means 58 and 57. The port 21 of the thermostat valve 15 is connected with the vacuum port 23*b* by way of a passage means 59. The diaphragm chamber 35 of the vacuum advancer 34 is connected with the port 31 of the vacuum operated valve 24 by way of passage means 60 and 61 on the one hand, while on the other hand it is connected with one port 43 of the delay means 41 by the passage means 60 and 62. The other port 44 of the delay means 41 is conencted with the port 39 of the check valve 36 by way of a passage means 63. The port 40 of the check valve 36 is connected with the valve port 30*a* of the vacuum operated valve 24 by way of a passage means 64. The port 32 of the vacuum operated valve 24 is connected with the vacuum port 23*a* by way of a passage means 65.

Figure 2:
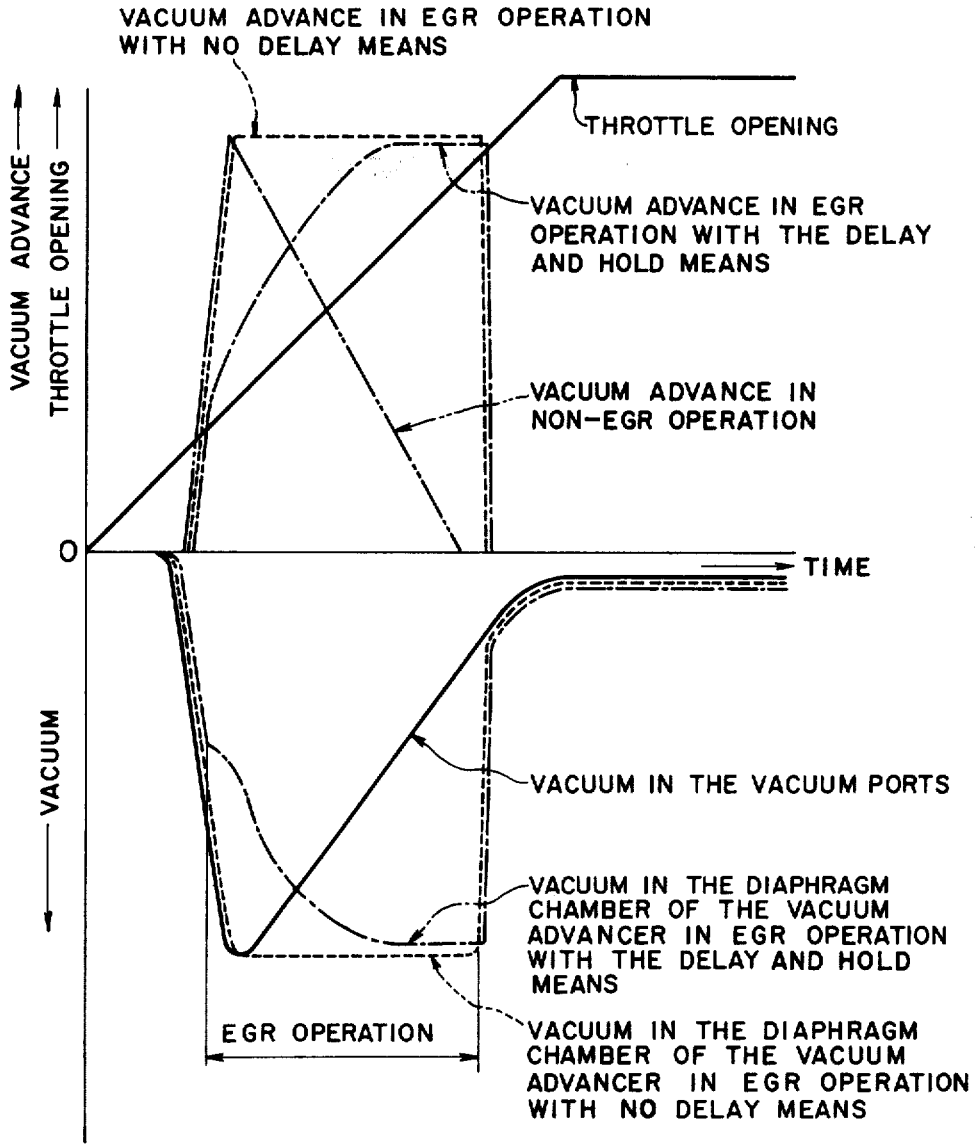
FIG. 2 is a graph illustrating performance of the device shown in FIG. 1 in comparison with those of a prior device.

Now, the operation of the ignition timing control device shown in FIG. 1 will be explained with reference to FIG. 2. FIG. 2 shows the relation between throttle opening, intake vacuum, and vacuum advance angle during constant speed operation of the engine.

When engine temperature is below a predetermined value, the valve element 17 of the thermostat valve 15 is positioned as shown in FIG. 1 so as to open the port 18 towards the atmosphere and to interrupt connection between the ports 18 and 21. In this condition, the diaphragm chamber 11 of the EGR valve 7 is supplied with atmospheric pressure. Therefore the valve element 9 of the EGR valve closes the valve port 8, so that the EGR passage means 6 is interrupted. In this condition, therefore, exhaust gas recirculation is not performed, regardless of the amount of opening of the throttle valve 22. In this condition, the diaphragm chamber 26 of the vacuum operated valve 24 is also supplied with atmospheric pressure. Therefore, the valve port **30*b* is opened so as to connect the ports 31 and 32, whereby the diaphragm chamber 35 of the vacuum advancer 34 is constantly connected with the vacuum port 23*a*. In this condition, therefore, vacuum advancing of ignition timing is performed in the conventional manner in accordance with opening or closing of the throttle valve 22. The two dotted chain line in FIG. 2** shows this performance.

When engine temperature rises beyond a predetermined value, the valve element 17 of the thermostat valve 16 is shifted rightwards in the figure, so as to connect the ports 18 and 21. In this condition, the diaphragm chamber 11 of the EGR valve 7 is connected with the vacuum port **23*b*, so that exhaust gas recirculation is performed in accordance with opening or closing operation of the throttle valve 22. That is, when the throttle valve 22 is fully closed as shown in the figure, exhaust gas recirculation is not performed, and when the throttle valve is opened so that its tip portion traverses the vacuum port 23*b*, the vaccum which appears in the vacuum port rapidly increases as shown by a solid line in FIG. 2, thereby opening the EGR valve and effecting exhaust gas recirculation. When the throttle valve is further widely opened, the vacuum acting in the vacuum port decreases, and when it becomes less than the value which corresponds to the set vacuum of the EGR valve 7** the EGR valve is closed and exhaust gas recirculation is stopped.

The diaphragm chamber 26 of the vacuum operated valve 24 is supplied with the same vacuum as that supplied to the diaphragm chamber 11 of the EGR valve 7. In this case, if the diaphragm means 25 of this vacuum operated valve is adjusted so as to perform its changeover operation at the same vacuum as the set vacuum for the EGR valve 7, the valve port **30*b* will be closed while the valve port 30*a* will be opened so as to interrupt connection between the ports 31 and 32 and so as to connect the port 32 and the valve port 30*a* only when exhaust gas recirculation is performed, and, when the EGR valve is closed so as not to perform exhaust gas recirculation, the valve port 30*a* will be closed while the valve port 30*b* will be opened so as to interrupt connection between the port 32 and the valve port 30*a* and so as to connect the ports 31 and 32. In this connection, if the check valve 36 is provided while the delay means 41 is not provided, as in the devices proposed in the aforementioned U.S. Pat. Nos. 4,191,143 and 4,191,147, when the valve port 30*b* of the vacuum operated valve 24 is closed, i.e. when exhaust gas recirculation is performed, during the process of opening the throttle valve 22, i.e. during acceleration of the engine, the high vacuum which appears in the vacuum port 23*a* when the tip portion of the throttle valve transverses the front of the vacuum port is immediately supplied to the diaphragm chamber 35 of the vacuum advancer 34 through the check valve 36, and this high vacuum is held in the space of the diaphragm chamber 35 and the passage means 60 and 63**, thereby maintaining the large vacuum advancing of ignition timing as long as exhaust gas recirculation is performed. This causes substantial increase of NOx emission in exhaust gases during accelerating operation.

However, when the vacuum delay means 41 is provided in series with the check valve 36 in accordance with the present invention, the high vacuum which appears in the vacuum port **23*a* during opening process of the throttle valve 22 is, since it is held in the surge space provided by the passage 63 and spaces 36*a* and 41*a* incorporated in the check valve 36 and the delay means 41 by the action of the check valve 36, not immediately supplied to the diaphragm chamber 35 of the vacuum advancer 34, but is supplied gradually with a delay effected by the delay means 41, as shown by one dotted chain line in FIG. 2**. By this delay of vacuum advancing of ignition timing, NOx emission in exhaust gases during acceleration is effectively reduced.

When the throttle valve is further opened so that the vacuum in the vacuum port decreases so as to be less than the set value of the EGR valve, or when the throttle valve is returned to its full closed position, the EGR valve is closed so as to stop exhaust gas recirculation, and at the same time the vacuum operated valve 24 is also changed over so as to open the valve port **30*b*, thereby releasing the high vacuum held in the diaphragm chamber 35 of the vacuum advancer 34 through the valve port 30*b***, so that vacuum advancing of ignition timing is immediately cancelled.

Figure 3:
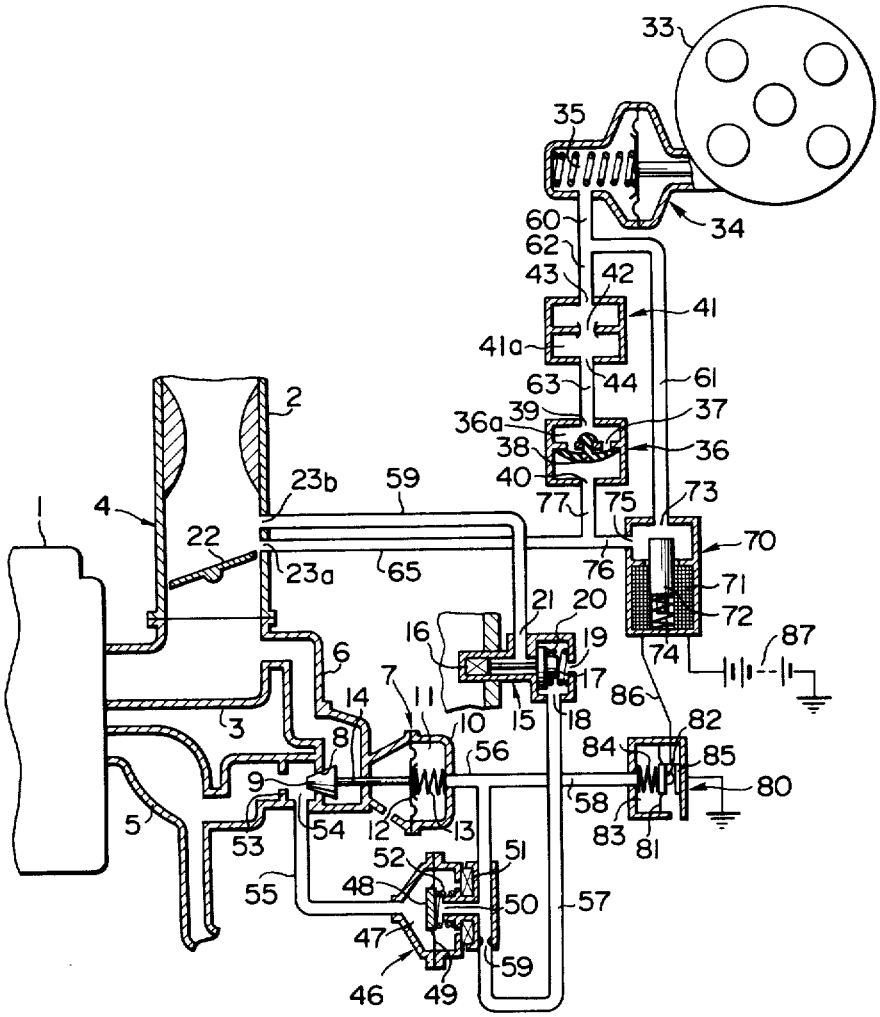
FIG. 3 is a diagrammatical view showing a second embodiment of the device of the present invention.

FIG. 3 is a diagrammatical view similar to FIG. 1, showing a second embodiment of the ignition timing control device of the present invention. In FIG. 3, the portions corresponding to those shown in FIG. 1 are designated by the same reference numerals as those used in FIG. 1. In this embodiment, the vacuum operated valve 24 in FIG. 1 is replaced by a combination of a solenoid valve 70 and a vacuum operated switch 80. The solenoid valve 70 has a solenoid 71 and a core 72 which is electromagnetically driven by the solenoid 71 and which operates as a valve element which opens or closes a valve port 73. When the solenoid 71 is not energized, the core 72 is shifted upwards in the figure by the force of a compression coil spring 74, so as to interrupt connection between the above-mentioned port 73 and another port 75, and when the solenoid 71 is energized, the core 72 is shifted downwards in the figure against the action of the compression coil spring 74, so as to open the port 73 and to connect this port and the port 75. The port 73 is connected with the diaphragm chamber 35 of the vacuum advancer 34 by way of passage means 61 and 60, and the port 75 is connected with the vacuum port **23*a* by way of passage means 76 and 65. The port 40 of the check valve 36 is connected with the vacuum port 23*a* by way of passage means 77 and 65**.

The vacuum operated switch 80 has a diaphragm 81 and a contact point 82 supported by said diaphragm, and is adapted to operate in such a manner that, when its diaphragm chamber 83 is not supplied with vacuum higher than a predetermined value, the diaphragm 81 is shifted rightwards in the figure by the force of a compression coil spring 84, so as to drive the contact point 82 into contact with a stationary contact point 85, and when the diaphragm chamber 83 is supplied with vacuum higher than a predetermined value, the diaphragm 81 is shifted leftwards in the figure against the action of the compression coil spring 84, so as to interrupt connection between the contact points 82 and 85. This vacuum operated switch 80 controls the power source circuit 86 for the solenoid 71 of the electromagnetic valve 70. The power source circuit includes a power source 87.

Also in this embodiment, when exhaust gas recirculation is not performed, the diaphragm chamber 83 of the vacuum operated switch 80 is not supplied with vacuum higher than a predetermined value, so that the switch is closed, the solenoid 71 of the electromagnetic valve 70 is energized, the port 73 is opened, the ports 73 and 75 are connected with each other, and the diaphragm chamber 35 of the vacuum advancer 34 is connected with the vacuum port 23*a* by way of a passage which passes through the electromagnetic valve 70. In this condition, therefore, vacuum advancing of ignition timing is performed in the conventional manner in accordance with opening and closing operation of the throttle valve 22.

By contrast, when exhaust gas recirculation is performed, the diaphragm chamber 83 of the vacuum operated switch 80 is supplied with vacuum higher than a predetermined value, so that the switch 80 is opened, the solenoid 71 of the electromagnetic valve 70 is de-energized, the core 72 closes the port 73, and the diaphragm chamber 35 of the vacuum advancer 34 is connected with the vacuum port 23*a* only by way of the passage means which includes the vacuum delay means 41 and the check valve 36 connected in series. Therefore, it will be apparent that the embodiment shown in FIG. 3 operates in the same manner as the first embodiment shown in FIG. 1

Figure 4:
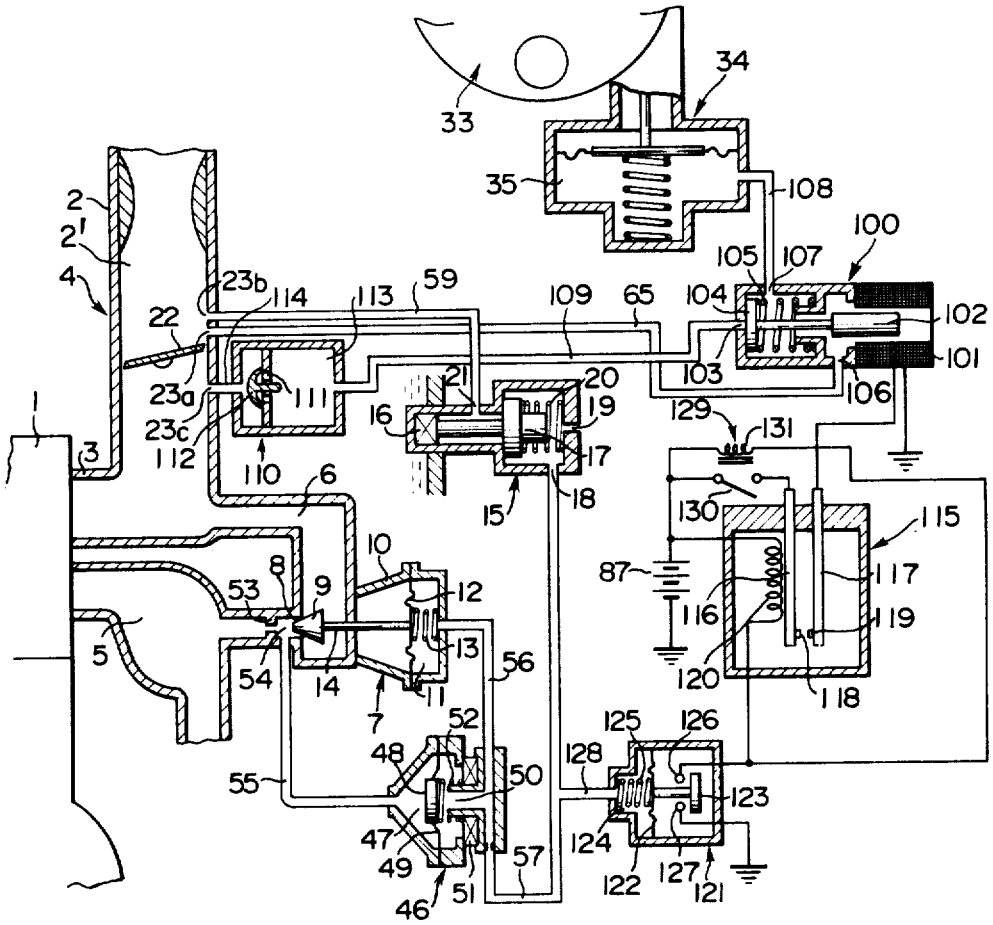
FIG. 4 is a diagrammatical view showing a third embodiment of the device of the present invention.

FIG. 4 is a diagrammatical view showing a third embodiment of the ignition timing control device of the present invention. Also in this figure the portions corresponding to those shown in FIG. 1 or 3 are designated by the same reference numerals as in FIG. 1 or 3. In the device shown in FIG. 4, 100 designates an electromagnetic control valve which has a solenoid 101 and a core 102 which is electromagnetically driven by the solenoid and which supports a valve element 104 which opens or closes a valve port 103. When the solenoid 101 is not energized, the valve element 104 is shifted leftwards in the figure by the force of a compression coil spring 105, so as to close the port 103 and to connect ports 106 and 107. By contrast, when the solenoid 101 is energized, the valve element 104 is shifted rightwards in the figure against the action of the comprssion coil spring 105, so as to open the port 103 and to close the port 106, thereby connecting the port 107 to the port 103, instead of the port 106. The port 107 is connected with the diaphragm chamber 35 of the vacuum advancer 34 by way of a passage means 108. The port 106 is connected with the vacuum port 23*a* by way of a passage means 65. The port 103 is connected with the vacuum port 23*c* by way of a passage means 109, a check valve 110, and a passage means 114.

The check valve 110 has a port 111 and a flexible umbrella-shaped valve element 112 which covers the port 111, and is adapted to allow fluid to flow only from the passage means 109 towards the passage means 114. Therefore, the check valve 110 operates to hold on the one side thereof which includes the passage means 109. Further, in the shown embodiment, the check valve 110 has a surge tank 113 of a predetermined volume on the one side of the valve element 112 which includes the passage means 109.

The solenoid 101 of the electromagnetic control valve 100 is supplied with electric current from a power source 87 by way of a delay switch 115 and a relay switch 129. The delay switch 115 has two bimetallic elements 116 and 117 which individually support contact points 118 and 119 arranged to oppose each other. The contact points 118 and 119 are adapted to contact each other when the bimetallic elements are heated by a heating coil 120 and are deformed, so as to close the switch 115. The heating coil 120 is supplied with electric current from the electric source 87 by way of a vacuum operated switch 121, which has a diaphragm 122 and a contact element 123 which is supported by the diaphragm and is adapted to co-operate with stationary contact points 126 and 127. When the diaphragm chamber 124 of the diaphragm means is not supplied with vacuum higher than a predetermined level, the diaphragm 122 is shifted rightwards in the figure by the force of a compression coil spring 125, so that the contact element 123 is parted from the stationary contact points 126 and 127 and the switch 121 is opened. By contrast, when the diaphragm chamber 124 is supplied with vacuum higher than a predetermined value, the diaphragm 122 is shifted leftward in the figure against the action of the compression coil spring 125, so that the contact element 123 engages the stationary contacts 126 and 127, thereby closing the switch 121. The diaphragm chamber 124 is connected with the passage means 57 by way of a passage means 128. The release switch 129 includes a normally open switch 130 connected in series with the delay switch 125 and a solenoid 131 which controls ON/OFF of the switch 130. The solenoid 131 is supplied with electric current from the power source 87 by way of the vacuum operated switch 121.

Operation of the device shown in FIG. 4 will be explained with reference to FIG. 5, which shows the relations between throttle opening, intake vacuum, and vacuum advancing of ignition timing.

Also in this embodiment, if engine temperature is below a predetermined value, the valve element 17 of the thermostat valve 15 is in the shown position, so that the port 18 is opened to the atmosphere, and the ports 18 and 21 are isolated from each other. In this condition, the diaphragm chamber 11 of the EGR valve 7 is supplied with atmospheric pressure, so that the EGR valve closes the port 8 and the EGR passage means 6 is interrupted. In this condition, therefore, exhaust gas recirculation is not performed, regardless of the opening of the throttle valve 22. In this condition, the diaphragm chamber 124 of the vacuum operated switch 121 is also supplied with atmospheric pressure, so that the switch is opened, so that no electric current is supplied to the heating coil 120 of the delay switch 115 or to the solenoid 131 of the release switch 129, and so that the switch 130 in series with the delay switch 115 is also opened. Therefore, the solenoid 101 of the electromagnetic control valve 100 is de-energized, whereby the valve element 104 closes the port 103, thereby connecting the ports 106 and 107 so as to connect the diaphragm chamber 35 of the vacuum advancer 34 to the vacuum port 23a. Therefore, in this condition, i.e. when exhaust gas recirculation is not performed, vacuum advancing of ignition timing is performed in the conventional manner in accordance with the intake vacuum which appears in the vacuum port 23a, as shown by a two dotted chain line in FIG. 5.

When engine temperature rises beyond a predetermined value, the valve element 17 of the thermostat valve 15 is shifted rightward in the figure, so as to close the port 19 and to connect the ports 18 and 21. In this condition, the diaphragm chamber 11 of the EGR valve 7 is connected to the vacuum port 23b. In this condition, therefore, exhaust gas recirculation is performed when substantial intake vacuum appears in the vacuum port 23b. That is, when the throttle valve 22 is in full closed position as shown in the figure, since no substantial vacuum appears in the vacuum port 23b, exhaust gas recirculation is not performed. When the throttle valve 22 is opened from this full closed position so that its tip portion traverses the front of the vacuum port 23b, substantial vacuum appears in the vacuum port 23b, so that the EGR valve 7 is opened, and exhaust gas recirculation is performed. When the throttle valve 22 is further widely opened, the vacuum which appears in the vacuum ports 23b now decreases, and when it further decreases to be less than the set vacuum of the EGR valve 7, the valve is closed and exhaust gas recirculation is stopped.

The diaphragm chamber 124 of the vacuum operated switch 121 is supplied with the same vacuum as supplied to the diaphragm chamber 11 of the EGR valve 7. In this case, if the vacuum operated switch is adjusted so as to operate at substantially the same vacuum as the set vacuum of the EGR valve 7, the switch is closed so as to supply electric current to the heating coil 120 of the delay switch 115 and the solenoid 131 of the release switch 129 only when the EGR valve 7 is opened so as to perform exhaust gas recirculation. In this case, when exhaust gas recirculation is initiated, the vacuum operated switch 121 is immediately closed, so as to supply electric current to the heating coil 120 of the delay switch 115 and to the solenoid 131 of the release switch 129. When the solenoid 131 is energized, the switch 130 is immediately closed. As the heating coil 120 generates heat due to supply of electric current, the bimetallic elements 116 and 117 are heated and are deformed. When a predetermined time has lapsed from the moment of initiating supply of electric current to the heating coil 120, the contact points 118 and 119 come into contact with each other due to thermal deformation of the bimetallic elements, so that the solenoid 101 of the electromagnetic control valve 100 is now energized. Then the valve element 104 of the electromagnetic control valve is shifted rightward in the figure against the action of the compression coil spring 105, so as to connect the ports 107 and 103. In this condition, the diaphragm chamber 35 of the vacuum advancer 34 is connected with the vacuum port 23c by way of the check valve 110.

Figure 5:
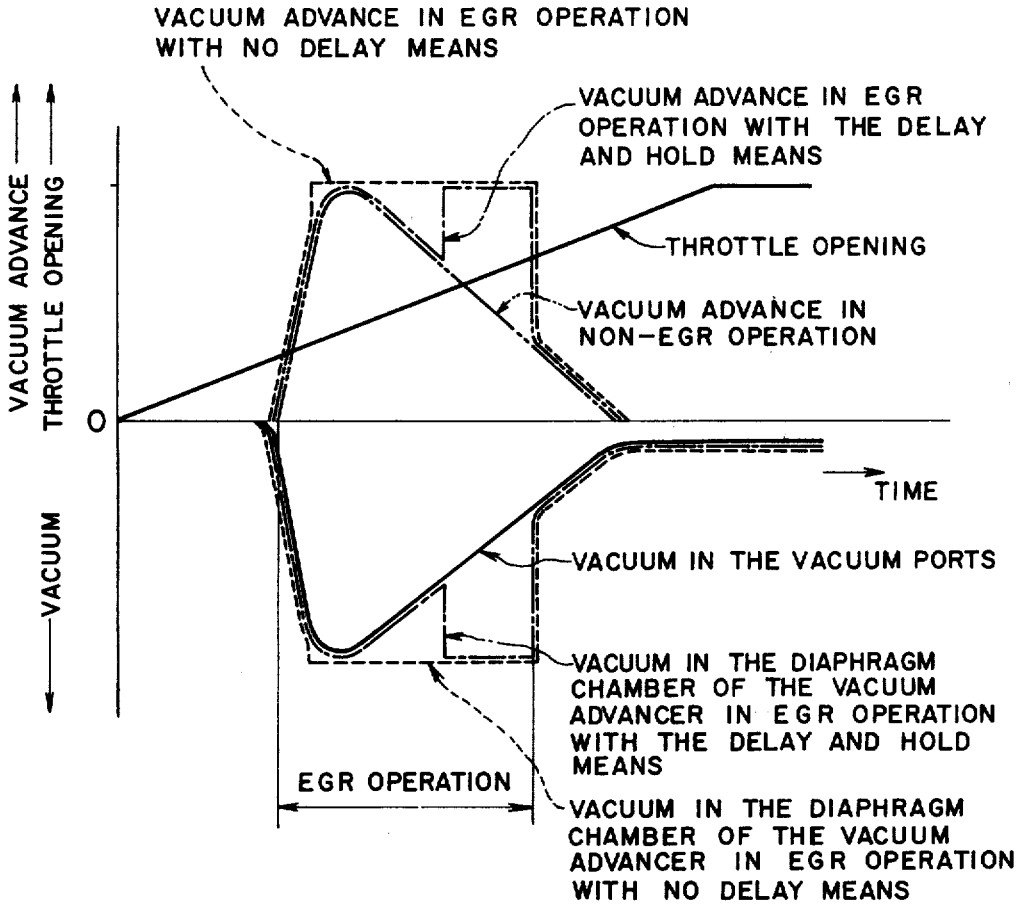
FIG. 5 is a graph illustrating performance of the device shown in FIG. 4.

In the prior device which includes a check valve incorporated in the vacuum passage means which connects the diaphragm chamber such as 35 of the vacuum advancer and the vacuum port such as 23b with no delay means being incorporated, when the throttle valve such as 22 is opened from its full closed position, intake vacuum which appears in the vacuum port is immediately supplied to the diaphragm chamber of the vacuum advancer, and the highest vacuum which appears in an early stage of opening of the throttle valve when the tip portion of the throttle valve traverses the vacuum port is held by the check valve, so that vacuum advancing of ignition timing is set at the largest value from the beginning of acceleration, as shown by a broken line in FIG. 5, thereby causing high emission of NOx in exhaust gases during acceleration of the engine.

However, in accordance with the present invention, since the electromagnetic control valve 100 is actuated after the lapse of a predetermined delay time from the moment of initiation of acceleration, the connection of the diaphragm chamber 35 of the vacuum advancer 34 to the vacuum port 23c by way of the check valve 110 is correspondingly delayed, and after the lapse of the delay time the vacuum supplied to the diaphragm chamber of the vacuum advancer is increased to the high vacuum level held in the surge tank 113 and the passage 109 by the action of the check valve 110 in the initial stage of opening of the throttle valve. This performance is shown in FIG. 5 by a one dotted chain line. After this, vacuum advancing of ignition timing is maintained at a high degree which corresponds to the high vacuum level as long as exhaust gas recirculation is performed. In this case, the degree of vacuum advancing of ignition timing can be adjusted by varying the volume of the surge tank 113.

By delaying vacuum advancing of ignition timing in the aforementioned manner, increase of NOx emission during acceleration, particularly during the initial stage of acceleration, is effectively avoided.

When the throttle valve 22 is further opened wide, or when it is returned to its full closed position, so that vacuum in the vacuum port 23b decreases so as to be less than the said vacuum level for the EGR valve 7, the valve is closed and exhaust gas recirculation is stopped. In this case, the vacuum operated switch 121 is opened, whereby the switch 130 is immediately opened and the solenoid 101 of the electromagnetic control valve 100 is de-energized. Therefore, the valve element 104 of the electromagnetic control valve 100 is shifted leftward in the figure so as to close the port 103 and to connect the ports 106 and 107. Therefore the diaphragm chamber 35 of the vacuum advancer 34 is again directly connected with the vacuum port 23a, so that vacuum advancing of ignition timing is performed in the conventional manner.

Figure 6:
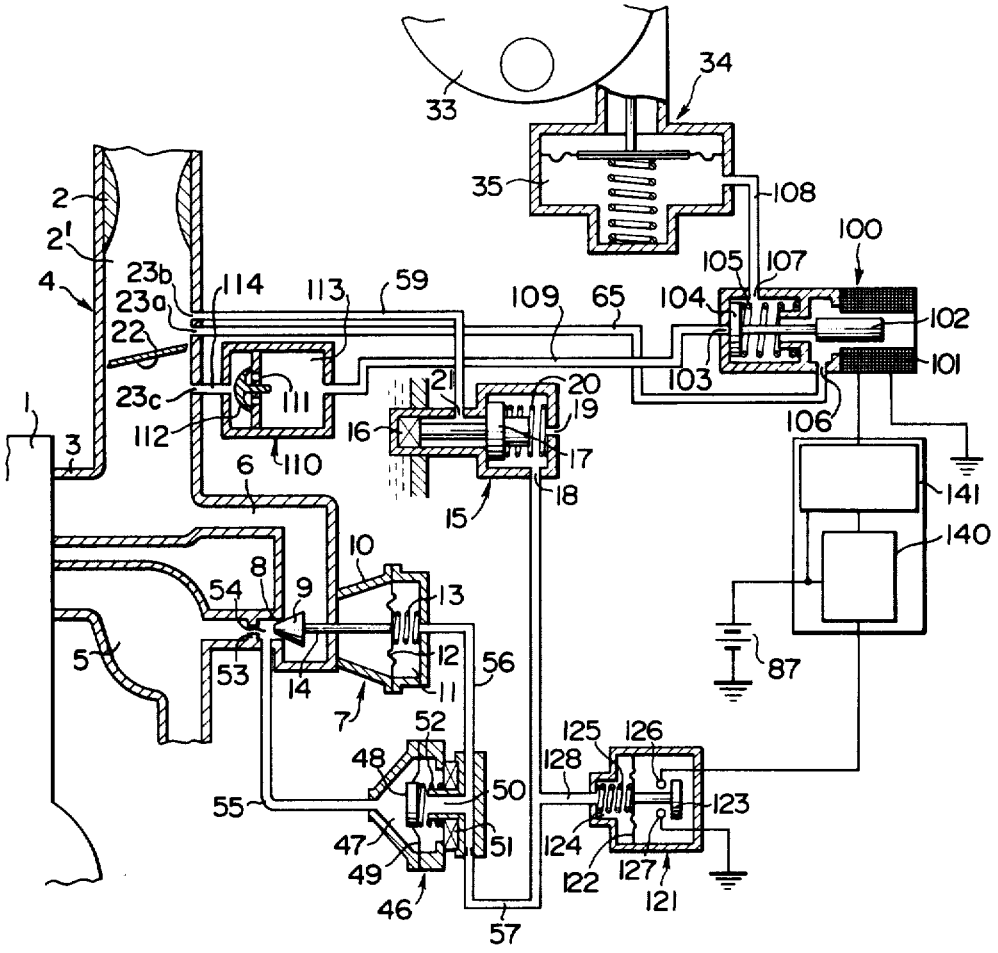
FIG. 6 is a diagrammatical view showing a fourth embodiment of the device of the present invention.

FIG. 6 is a view similar to FIG. 4, showing a fifth embodiment of the ignition timing control device of the present invention. In FIG. 6, the portions corresponding to those shown in FIG. 4 are designated by the same reference numerals as in FIG. 4. In this embodiment, the combination of the delay switch 115 and the release switch 129 in FIG. 4 is replaced by a combination of an electronic timing circuit 140 and an amplifier 141. The timing circuit 140 may be a combination of a monostable multivibrator and a latch unit which are themselves will known in the art, an IC timer employing integrated circuits or other combinations of thermistors, heaters, and/or comparators. The timer circuit 140 is adapted to operate the amplifier 141 after the lapse of a predetermined time from the moment when the vacuum operated switch 121 is closed, so as to supply electric current to the solenoid 101, and is adapted to operate the amplifier 141 immediately when the vacuum operated switch 121 is opened, so as to stop supplying electric current to the solenoid 101. It will be apparent that this fourth embodiment operates in the same manner as the third embodiment shown in FIG. 4.

Although the invention has been shown and described with respect to some preferred embodiments thereof, it should be understood by those skilled in the art that various changes to and omissions of the form and the detail thereof may be made therein without departing from the scope of the invention.

We claim:

1. An ignition timing control device for an internal combustion engine having intake and exhaust passages and an exhaust gas recirculation system which includes an exhaust gas recirculation control valve and selectively recirculates exhaust gases from said exhaust passage to said intake passage, comprising:

a vacuum advancer which has a diaphragm means and advances ignition timing of the engine in accordance with vacuum supplied to said diaphragm means, first and second passage means which alternatively connect said intake passage and said diaphragm means so as to conduct fluid pressure therebetween, a delay and hold means related with said second passage means which includes a check valve, a surge space and a delay means and delays transmission of vacuum from said intake passage to said diaphragm means effected through said second passage means, while it holds the largest vacuum generated in said second passage means for said diaphragm means, and a changeover means which changes over connection of said intake passage and said diaphragm means between a route through said first passage means and a route through said second passage means in accordance with operation of said exhaust gas recirculation system so that, when exhaust gas recirculation is not performed, said intake passage and said diaphragm means are connected through said first passage means, and, when exhaust gas recirculation is performed, said intake passage and said diaphragm means are connected through said second passage means.

2. The device of claim 1, wherein said delay means is a throttling orifice incorporated in said second passage means.

3. The device of claim 1, wherein said delay means is a timer which delays changing over operation of said changeover means from the moment of initiation of operation of said exhaust gas recirculation system.

4. The device of claim 1, wherein said exhaust gas recirculation control valve and said change over means are vacuum operated valves adapted to be operated by the same vacuum.

5. The device of claim 1, wherein said exhaust gas recirculation control valve is a vacuum operated valve and said change over means is a combination of a vacuum operated switch and an electromagnetic valve.

6. The device of claim 3, wherein said timer includes bimetallic elements which operate as switching contacts and an electric heating element which heats said bimetallic elements.

7. The device of claim 3, wherein said timer includes an electronic timing circuit.

8. The device of any one of claims 1 through 5, further comprising a thermostat which suppresses operation of said exhaust gas recirculation system when engine temperature is below a predetermined value.

* * * * *